US008768228B2

(12) United States Patent
Nakaegawa

(10) Patent No.: US 8,768,228 B2
(45) Date of Patent: Jul. 1, 2014

(54) IMAGE FORMING APPARATUS

(75) Inventor: Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 13/312,874

(22) Filed: Dec. 6, 2011

(65) Prior Publication Data

US 2012/0148301 A1 Jun. 14, 2012

(30) Foreign Application Priority Data

Dec. 13, 2010 (JP) ..... 2010-277322

(51) Int. Cl.
*G03G 15/14* (2006.01)

(52) U.S. Cl.
USPC ..... 399/315

(58) Field of Classification Search
USPC ..... 399/303, 313, 315, 397, 398
See application file for complete search history.

(56) References Cited

U.S. PATENT DOCUMENTS

2009/0279918 A1* 11/2009 Sendo et al. ..... 399/121
2010/0239335 A1* 9/2010 Sawai ..... 399/319

FOREIGN PATENT DOCUMENTS

JP 5-119636 A 5/1993
JP 5-341664 A 12/1993
JP 9-015987 A 1/1997

* cited by examiner

*Primary Examiner* — David Gray
*Assistant Examiner* — Gregory H Curran
(74) *Attorney, Agent, or Firm* — Canon USA Inc IP Division

(57) ABSTRACT

A charge elimination needle is set at a predetermined position (first position) when a recording material is separated by utilizing the curvature of a separation stretching roller without using a separation assist roller, and at a position (second position) higher than the first position when the recording material is separated by using the separation assist roller.

4 Claims, 8 Drawing Sheets

IMAGE FORMING APPARATUS

BACKGROUND OF THE INVENTION

1. Field of the Invention

The present invention relates to an image forming apparatus, such as a copying machine or a laser printer, which transfers a toner image carried on an image bearing member onto a recording material by electrophotography. More particularly, the present invention relates to an image forming apparatus including a transfer belt that transfers and conveys a recording material.

2. Description of the Related Art

In an electrophotographic apparatus in which a recording material is held and conveyed by a transfer belt stretched by a plurality of rollers, the recording material on the transfer belt is electrostatically attracted to the transfer belt when passing through a transfer nip.

However, if the stiffness of the recording material is low, it is difficult to separate the recording material from the transfer belt by utilizing only the stiffness of the recording material and the curvature of a separation roller serving as a separation stretching member that stretches the transfer belt. That is, the recording material remains attached to the transfer belt at the position of the separation roller, and this causes separation failure. Accordingly, Japanese Patent Laid-Open No. 9-15987 discloses a structure for separating a recording material by uniformly forming projections on a surface of a separation roller for stretching a transfer belt so as to undulate the transfer belt at a separating position. While this structure allows the transfer belt to be undulated at the separating position, great tension constantly and locally acts on the transfer belt. As a result, the transfer belt locally wears, and the resistance becomes nonuniform. This makes transfer performance unstable.

Japanese Patent Laid-Open No. 5-119636 discloses a method for deforming a transfer sheet bearing a recording material for separation of the recording material while reducing wear due to deformation. In the method of Japanese Patent Laid-Open No. 5-119636, a roller is provided as a raising member that is movable between a position so as to raise the transfer sheet from an inner side and a position so as not to raise the transfer sheet. In this method, the recording material is separated by raising the transfer sheet by the roller. The transfer sheet is not raised while the recording material is not separated. To separate recording materials of various thicknesses without deforming the transfer sheet more than necessary, a thin recording material is raised by a large raising amount, and a thick recording material is raised by a small raising amount.

SUMMARY OF THE INVENTION

The present disclosure provides an image forming apparatus in which, even when a recording material is separated from a belt by using a raising unit, reduction of an effect of a charge elimination needle for eliminating charge from the separated recording material is suppressed.

An image forming apparatus according to an aspect of the present invention includes an image bearing member configured to bear a toner image; a movable belt member configured to bear and convey a recording material; a transfer member configured to electrostatically transfer the toner image formed on the image bearing member onto the recording material born and conveyed by the belt member; a raising unit configured to raise the belt member from an inner surface side at a position downstream of the transfer member in a conveying direction of the recording material so the belt member locally projects in a width direction of the belt member; a separation stretching member configured to stretch the belt member at a position downstream of the raising unit in the conveying direction of the recording material to separate the recording material from the belt member; a charge elimination needle arranged downstream of the separation stretching member in the conveying direction of the recording material to eliminate a charge from the recording material; an execution unit configured to execute a first mode in which a recording material having a first thickness is conveyed by the belt member and is separated by the separation stretching member without raising the belt member by the raising unit and a second mode in which a recording material having a second thickness less than the first thickness is conveyed by the belt member and the belt member is raised by the raising unit; and a charge-elimination-needle moving unit configured to move the charge elimination needle so the charge elimination needle is located at a first position in the first mode and the charge elimination needle is located at a second position higher than the first position in a perpendicular direction perpendicular to a surface of the transfer belt that is not raised by the raising unit between the transfer member and the separation stretching member in the second mode.

Further features of the present invention will become apparent from the following description of exemplary embodiments with reference to the attached drawings.

DESCRIPTION OF THE EMBODIMENTS

First Embodiment

Image Forming Apparatus

Figure 1A:
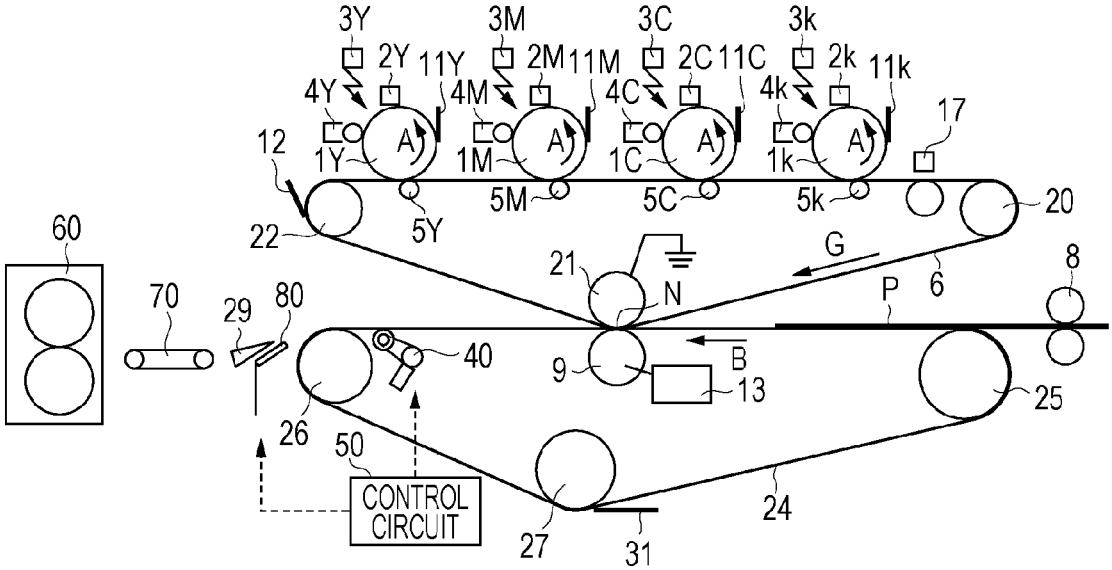
FIGS. 1A and 1B illustrate an image forming apparatus.

A description will be given of the configuration and operation of an image forming apparatus according to a first embodiment with reference to FIG. 1A.

Photosensitive drums 1 (1Y, 1M, 1C, and 1K) rotate in a direction of arrow A, and function as image bearing members. Surfaces of the photosensitive drums 1Y, 1M, 1C, and 1K are uniformly charged at a predetermined voltage by charging devices 2Y, 2M, 2C, and 2K, respectively. The charged surfaces of the photosensitive drums 1Y, 1M, 1C, and 1K are exposed by exposure devices 3Y, 3M, 3C, and 3K formed by laser beam scanners, respectively, so as to form electrostatic latent images thereon. By turning on and off the outputs from the laser beam scanners according to image information, electrostatic latent images corresponding to an image are formed on the photosensitive drums. Developing devices 4Y, 4M, 4C, and 4K contain toners of chromatic colors of yellow (Y), magenta (M), cyan (C), and black (K), respectively. A predetermined voltage is applied to the developing devices. While passing through the developing devices 4Y, 4M, 4C, and 4K, the above-described electrostatic latent images are developed to form toner images on the photosensitive drums 1Y, 1M, 1C, and 1K. The electrostatic latent images are developed by a reversal developing method in which toner is attached to exposed portions of the electrostatic latent images.

The toner images formed on the photosensitive drums 1Y, 1M, 1C, and 1K are primarily transferred onto an intermediate transfer belt 6 by corresponding primary transfer rollers 5Y, 5M, 5C, and 5K. Thus, four color toner images are transferred and superimposed on the intermediate transfer belt 6. The intermediate transfer belt 6 functions as an image bearing member that bears the toner images. The intermediate transfer belt 6 is located in contact with the surfaces of the photosensitive drums 1, and is rotated at 300 mm/sec in a direction of arrow G while being stretched by stretching rollers 20, 21, and 22 serving as a plurality of stretching members. In the first embodiment, the stretching roller 20 is a tension roller that performs control so that the tension of the intermediate transfer belt 6 is fixed, and the stretching roller 22 is a driving roller that drives the intermediate transfer belt 6.

A transfer belt 24 functions as a belt member that bears and conveys a recording material. The transfer belt 24 is stretched by stretching rollers 25, 26, and 27 serving as a plurality of stretching members, and is movable at 300 mm/sec in the direction of arrow B. The stretching roller 25 is a driving roller for the transfer belt 24. The driving roller 25 is obtained by forming a conductive rubber material having a thickness of 1.5 mm and a volume resistivity less than $10^5$ Ω·cm around an SUS core metal having an outer diameter of 20 mm. The stretching roller 26 is a separation roller that separates the recording material, and is formed by an SUS roller having an outer diameter of 19 mm. The transfer belt 24 is formed of a resin material such as polyimide or polycarbonate, or a rubber material containing an appropriate amount of carbon black serving as an antistatic agent. The transfer belt 24 has a volume resistivity of $5.0\times10^9$ to $1.0\times10^{12}$ Ω·cm (measured with a probe compliant with JIS K6911 under a condition including an applied voltage of 100 V, an application time of 60 sec, and an environment of 23° C. and 50% RH), a thickness of 0.05 mm, and a rubber hardness (compliant with JIS K6253) of 60° to 75°. Also, the material of the transfer belt 24 is an elastic material having a Young's modulus of 0.5 to 10 MPa measured by a tensile test (JIS K6301).

The use of a member having a Young's modulus of 0.5 MPa or more measured by the tensile test allows the transfer belt 24 to be rotated while sufficiently maintaining its shape. On the other hand, the use of a member having a Young's modulus of 10 MPa or less and capable of sufficiently elastic deformation can effectively undulate a recording material P by a below-described separation assist device 40, and allows more effective separation of the recording material P from the transfer belt 24. Further, since a relaxation phenomenon is likely to occur when the amount of deformation of the sufficiently elastic deformable member is reduced from a deformed state, wear of the transfer belt 24 due to the separation assist device 40 can be reduced.

Recording materials are stored in a cassette (not illustrated). In response to the output of a supply start signal, a recording material P is conveyed from the cassette by an unillustrated roller and is guided to registration rollers 8. The registration rollers 8 temporarily stop the recording material P, and then supply the recording material P to the transfer belt 24 in synchronization with conveyance of a toner image on the intermediate transfer belt 6.

Downstream of the registration rollers 8 in a recording-material conveying direction (direction of arrow B), a secondary transfer roller 9 opposes the intermediate-transfer-belt stretching roller 21 to form a transfer nip N, where the toner images are transferred onto the recording material P held on the transfer belt 24. That is, the secondary transfer roller 9 serves as a transfer member that transfers the toner images from the image bearing member (intermediate transfer belt 6) onto the recording material P held on the belt member (transfer belt 24) by pressing the belt member against the image bearing member.

The secondary transfer roller 9 includes an elastic layer of ion conductive foamed rubber (NBR rubber) and a core metal. The secondary transfer roller 9 has an outer diameter of 24 mm, a roller surface roughness (Rz) of 6.0 to 12.0 μm, and a resistance of 1E+5 to 1E+7Ω measured in an N/N environment (23° C., 50% RH) by applying a voltage of 2 kV). The secondary transfer roller 9 is provided with a secondary-transfer high-voltage power supply 13 whose supply bias is variable.

Before a leading end of the recording material P reaches the transfer nip N, a voltage having a polarity opposite the toner polarity is applied to the secondary transfer roller 9 as a secondary transfer bias that transfers the toner images on the intermediate transfer belt 6 onto the recording material P. When the recording material P reaches the transfer nip N, the toner images on the intermediate transfer belt 6 are electrostatically transferred together onto the recording material P. The transfer is performed while subjecting the secondary transfer bias to constant voltage control. A target constant voltage is determined by various factors, such as a dry state of the recording material, environment, and amount of toner to be transferred, and is set to be within the range of 1000 to 5000 V.

After transfer, the recording material P is separated from the transfer belt 24, and its charge is eliminated from a back side by a charge elimination needle 80. Then, the recording material P is conveyed to a fixing device 60 after passing over a guide surface of a recording-material guide 29 and a recording-material conveying device 70. When the recording material P is conveyed to the fixing device 60, the toner images are fixed on the recording material P by a heating and pressurizing process with a fixing roller and a pressurizing roller. After the toner images are fixed, the recording material P is output from the apparatus.

Structure of Separation Assist Device 40

The first embodiment adopts a separation assist device 40 as a raising unit that raises the transfer belt 24 in order to assist in separation from the transfer belt 24. The separation assist device 40 separates the recording material by locally raising and deforming the transfer belt 24. Although described in detail below, when the separation assist device 40 raises the transfer belt 24, the transfer belt 24 and the recording material P are brought into a state illustrated in FIG. 1B. The separation assist device 40 is provided downstream of the secondary transfer roller 9 and upstream of the separation stretching roller 26 in the recording-material conveying direction, and on an inner side of the transfer belt 24.

Figure 2A:
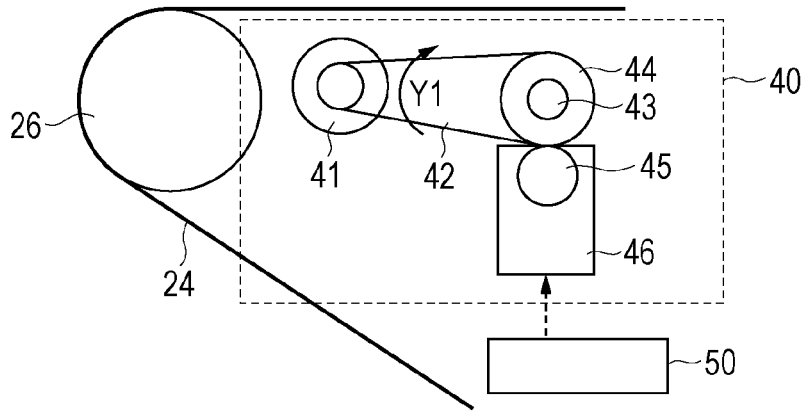
FIGS. 2A and 2B illustrate the motion of a separation assist roller.
Figure 2B:
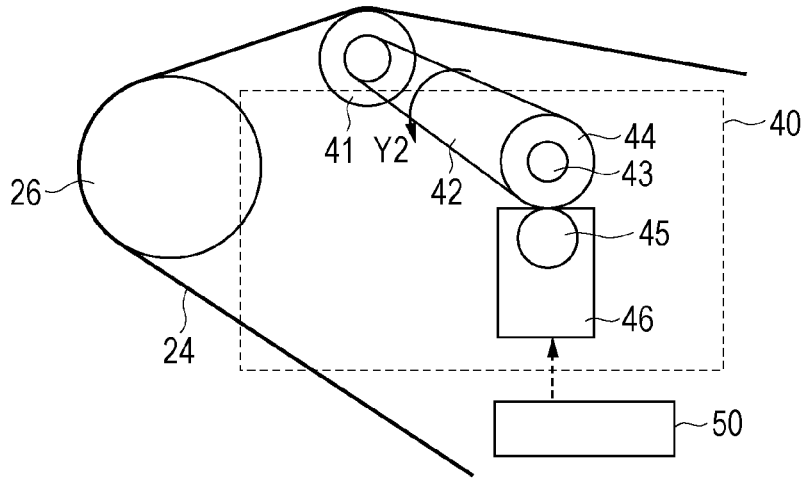

FIGS. 2A and 2B illustrate in detail the structure and operation of the separation assist device 40. The separation assist device 40 includes a separation assist roller 41 serving as a raising member, a roller frame 42 that supports the separation assist roller 41 rotatably, and a roller swing center shaft 43 serving as a center of swing of the separation assist roller 41. The separation assist device 40 further includes a roller drive gear 44 that swings the separation assist roller 41 on the roller swing center shaft 43, a motor drive transmission gear 45 that transmits driving force to the roller drive gear 44, and a motor 46 serving as a drive source. Rotational motion of the motor 46 is transmitted to the roller drive gear 44 by the motor drive transmission gear 45. Since a bearing is provided between the roller drive gear 44 and the roller swing center shaft 43, the roller swing center shaft 43 is not influenced by the rotational driving of the motor 46, and therefore does not move.

FIG. 2A illustrates a retracting position where the separation assist roller 41 is separate from the transfer belt 24 and retracts from a raising position. FIG. 2B illustrates a raising position where the separation assist roller 41 is in contact with an inner surface of the transfer belt 24 and raises the transfer belt 24 locally. The separation assist roller 41 can be swung on the roller swing center shaft 43 in a Y1-direction from the roller retracting position of FIG. 2A to the raising position of FIG. 2B by a predetermined amount of forward rotation of the motor 46. Also, the separation assist roller 41 can be swung in a Y2-direction from the raising position of FIG. 2B to the retracting position of FIG. 2A by a predetermined amount of reverse rotation of the motor 46. That is, the separation assist roller 41 is thus swung by forward and reverse rotations of the motor 46.

The separation assist roller 41 is formed of ethylene propylene rubber (EPDM), and has an outer diameter of 6 to 10 mm and a width of 5 to 15 mm. When the separation assist roller 41 raises the transfer belt 24, a local projection is formed on the transfer belt 24 in the width direction. Here, the width direction refers to a direction orthogonal to a moving direction of a belt surface of the transfer belt 24.

In the state of FIG. 2A, the distance from the separation assist roller 41 to the separation stretching roller 26 is 4 to 8 mm. In the state of FIG. 2B, the separation assist roller 41 raises the belt surface of the transfer belt 24 from the inner side by 3 to 6 mm from the flat state of FIG. 2A.

Figure 1B:
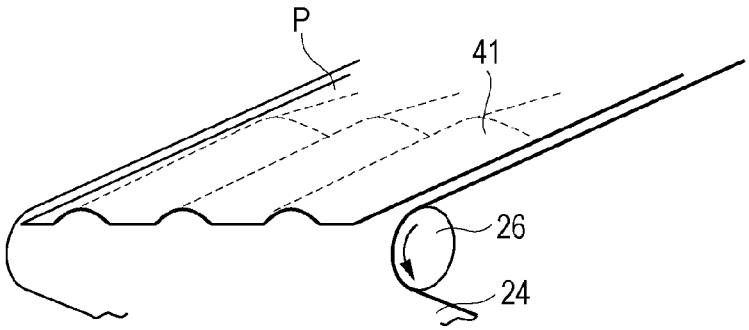

A description will be given of a separation assist effect of the separation assist device 40. Since the charge having the polarity opposite the toner polarity is applied from the secondary transfer roller 9 to the inner surface of the transfer belt 24, the recording material is attracted on the transfer belt 24 after passing through the transfer nip N. In this case, a recording material having a low stiffness, such as thin paper, may be insufficiently separated by utilizing only the curvature of the separation stretching member 26. Accordingly, in the first embodiment, the separation assist device 40 raises the transfer belt 24. Since a recording material having a low stiffness, such as thin paper, is prone to deform, it is undulated along local deformation of the raised transfer belt 24 in the width direction, as illustrated in FIG. 1B. As a result, the second moment of area of the recording material, that is, stiffness of the recording material increases. This allows effective separation of the recording material having a low stiffness such as thin paper.

In the separation assist device 40, only one separation assist roller 41 may be provided in a passing area of the recording material. In this case, however, an area where the recording material is undulated in the width direction is narrow. To undulate the recording material in the width direction, a plurality of separation assist rollers 41 can be provided in the width direction in the passing area of the recording material.

Figure 3:
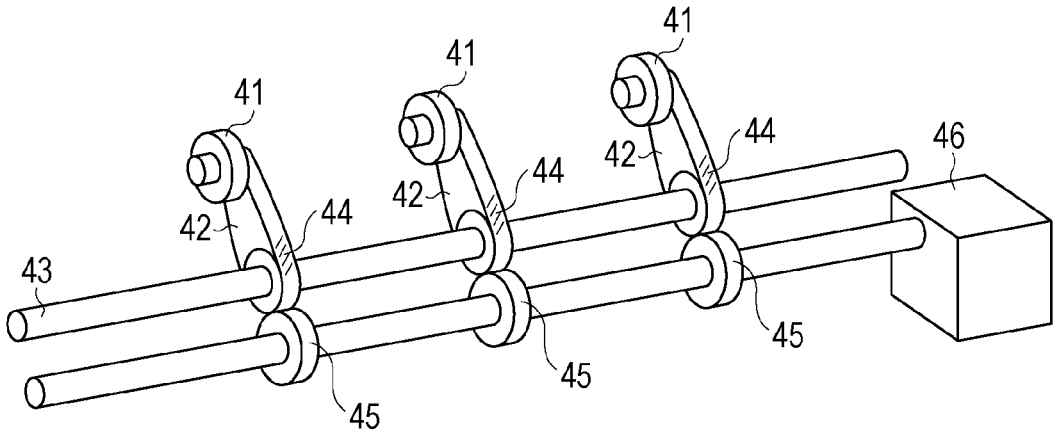
FIG. 3 illustrates a structure of a separation assist device.

FIG. 3 is a perspective view of the separation assist device 40. In the first embodiment, three separation assist rollers 41 are arranged in the width direction. The distance between the adjacent separation assist rollers 41 is 125 mm. The distance between the separation assist rollers 41 provided at opposite ends is 250 mm. The center separation assist roller 41 is located at almost the center in the width direction of a recording material to be conveyed so that the center of the recording material substantially coincides with a common reference line, regardless of the size of the recording material. Particularly when an A4-sized thin recording material having a width of 297 mm is conveyed, it is raised at three positions. This is effective in enhancing separability of the A4-sized recording material.

Control of Separation Assist Device 40

Figure 4:
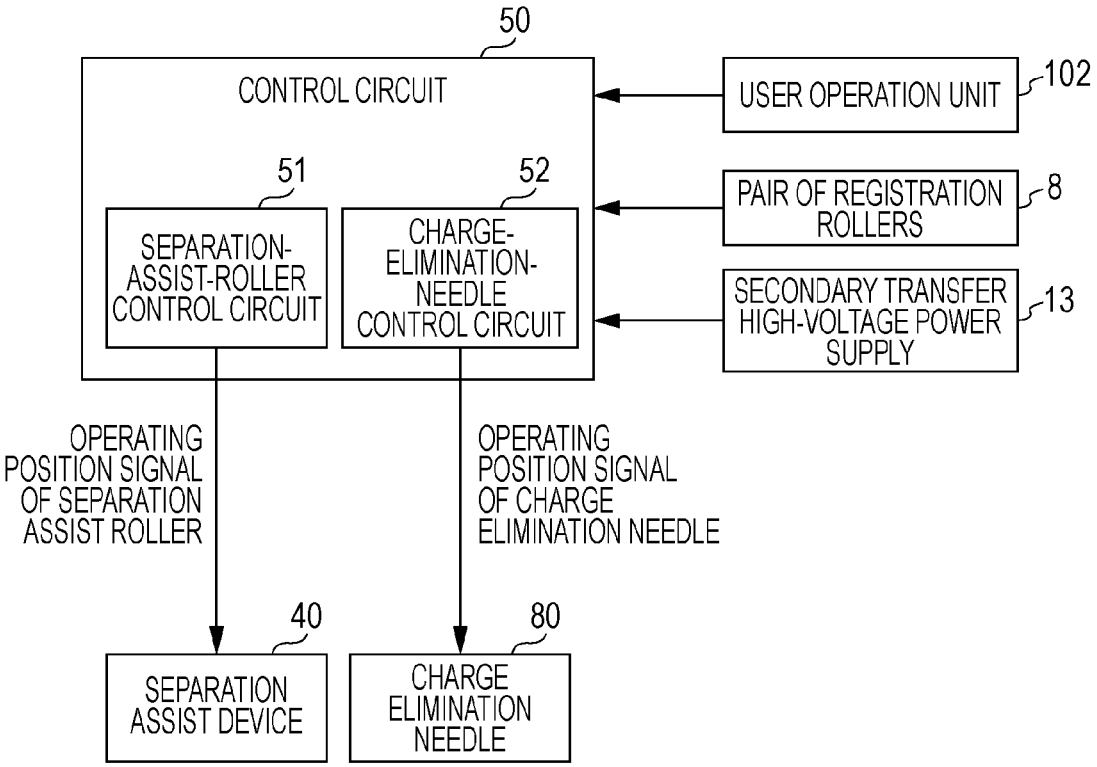
FIG. 4 is a block diagram of a control circuit according to a first embodiment.

The operating position of the separation assist device 40 is controlled by a separation-assist-roller control circuit 51 provided in a control circuit 50. FIG. 4 illustrates a control system. An operating position signal of the separation assist device 40 is controlled on the basis of basis weight information of a recording material P specified by the user and recording-material leading-end position information obtained from a recording-material feeding timing of the registration rollers 8 and a conveying speed of the recording material P. The control circuit 50 receives information from an operation unit 102 where the user operates an image forming section, an operation timing of the registration rollers 8, and information about a secondary transfer current from the secondary-transfer high-voltage power supply 13. The control circuit 50 includes a CPU, a ROM, and a RAM. Although described in detail below, the control circuit 50 also includes a charge-elimination-needle control circuit 52 that controls an operating position of a charge elimination needle 80.

The basis weight is a unit that indicates the weight per unit area ($g/m^2$), and is generally used as a value indicating the thickness of the recording material.

In the first embodiment, the ROM prestores the following two control patterns for the operating position of the separation assist device 40:

(1) When the basis weight of the recording material is 40 $g/m^2$ or less, the separation assist rollers 41 are located at a raising position so as to project the transfer belt 24 locally in the width direction. The recording material is separated from the transfer belt 24 by forming such local projections by raising; and (2) When the basis weight of the recording material is larger than 40 $g/m^2$, the separation assist rollers 41 are located at a retracting position. At the retracting position, the separation assist rollers 41 are separate from the transfer belt 24. The recording material is separated from the transfer belt 24 by utilizing the curvature of the separation stretching roller 26.

That is, an operation mode in which the separation assist rollers 41 are raised toward a recording material having a specific basis weight (second basis weight) is executed (second mode). In contrast, for a recording material having a first basis weight larger than the second basis weight, an operation mode in which the recording material is separated by the separation stretching roller 26 without raising the separation assist rollers 41 is executed (first mode). As a result, application of local load is prevented from being caused by raising the transfer belt 24 more than necessary. In this way, the control circuit 50 serves as an execution unit that executes these two modes.

The basis weight of the recording material is sometimes input by the user through the operation unit 102, or is sometimes input to a storage portion that stores recording materials. On the basis of information about the basis weight thus input to the image forming apparatus, the control circuit 50 determines the operation of the separation assist device 40.

Structure of Charge Elimination Needle 80

In the first embodiment, a charge elimination needle 80 for eliminating charge from the recording material is provided to prevent the toner on the recording material from being scattered by separating discharge caused when the recording material is separated from the transfer belt 24. The charge elimination needle 80 is located downstream of the separation stretching roller 26 and upstream of the recording-material guide 29 in the recording-material conveying direction. In the first embodiment, the charge elimination needle 80 is movable, and is electrically grounded. Alternatively, bias may be applied to the charge elimination needle 80.

Figure 5A:
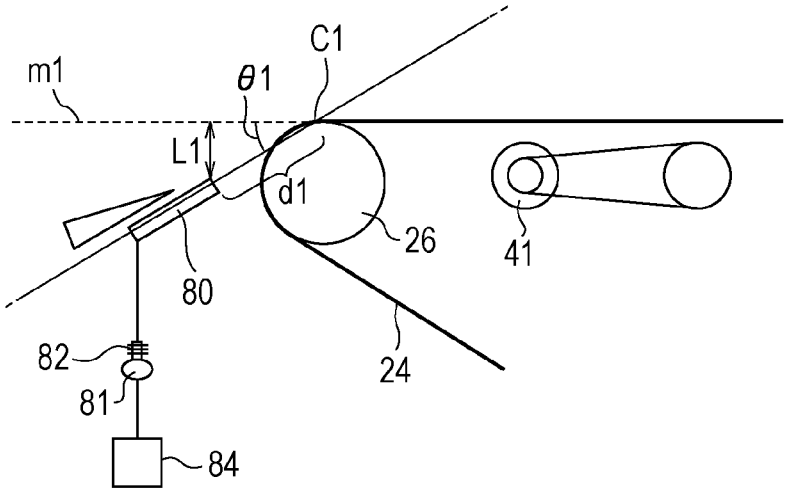
FIGS. 5A and 5B illustrate the motion of a charge elimination needle.
Figure 5B:
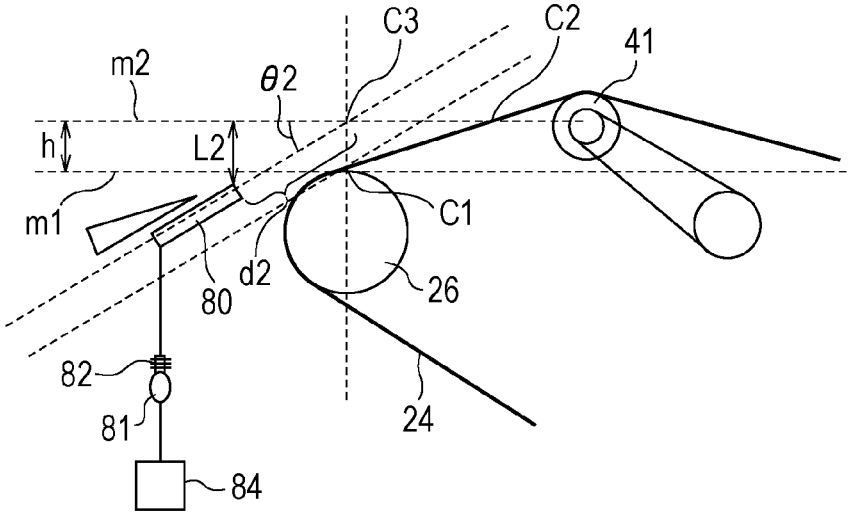

FIGS. 5A and 5B illustrate in detail the operation and control of the charge elimination needle 80. A cam 81 is turned by driving force from a motor 84, and serves as a pedestal of a holder that holds the charge elimination needle 80 with a spring 82 being disposed therebetween. When the cam 81 is turned, the charge elimination needle 80 translates in a perpendicular direction perpendicular to an unraised belt surface.

FIG. 5A illustrates a position (first position) of the charge elimination needle 80 taken when the transfer belt 24 is not raised by the separation assist rollers 41. FIG. 5B illustrates a position (second position) of the charge elimination needle 80 taken when the transfer belt 24 is raised by the separation assist rollers 41. The charge elimination needle 80 can be moved by turning of the cam 81 from the first position of FIG. 5A to the second position of FIG. 5B. Further, the charge elimination needle 80 can be moved by turning of the cam 81 from the second position of FIG. 5B to the first position of FIG. 5A.

When the distance between a back surface of the recording material and the charge elimination needle 80 is short, the charge elimination effect becomes excessive, and this may cause toner scattering. In contrast, when the distance between the back surface of the recording material and the charge elimination needle 80 is long, the charge elimination effect is not sufficiently exerted. That is, the distance between the back surface of the recording material and the charge elimination needle 80 needs to be set at a predetermined value adequate to exert the charge elimination effect. However, when the recording material is separated by using the separation assist rollers 41, a separating position of the recording material is on an upstream side. As a result, the position of the recording material after separation when the separation assist rollers 41 are used is higher in a direction perpendicular to the belt surface after transfer than when the separation assist rollers 41 are not used. When the separation assist rollers 41 are used, the distance between the back surface of the recording material and the charge elimination needle 80 increases, and therefore, the charge elimination effect of the charge elimination needle 80 for the recording material decreases.

Accordingly, in the first embodiment, the charge elimination needle 80 is located at a predetermined position (first position) when the recording material is separated by utilizing the curvature of the separation stretching roller 26 without using the separation assist rollers 41, and is located at a position (second position) higher than the first position when the recording material is separated by using the separation assist rollers 41.

Here, the height refers to a height in a direction perpendicular to the belt surface of the transfer belt 24 from the secondary transfer portion to the separation stretching roller 26 in a state in which the transfer belt 24 is not raised by the separation assist rollers 41 (perpendicular direction). In the first embodiment, as for the height relationship, the intermediate transfer belt 6 side is higher and the secondary transfer roller side is lower.

First, the first position of the charge elimination needle 80 illustrated in FIG. 5A will be described. In FIG. 5A, m1 denotes an extension line of the belt surface of the transfer belt 24 in an unraised state. When a recording material reaches an upstream end C1 in the belt rotating direction of an area where the transfer belt 24 contacts with the separation stretching roller 26, it separates from the transfer belt 24. The separated recording material is conveyed along the extension line m1. In the first embodiment, a distance L1 between m1 and a tip of the charge elimination needle 80 in the perpendicular direction perpendicular to the unraised belt surface of the transfer belt 24 is set at a predetermined value (7.9 mm). As a result, the charge elimination effect is prevented from becoming excessive because of a short distance between the back surface of the recording material and the charge elimination needle 80, and from deteriorating because of a long distance therebetween. The distance L1 is not limited to this value, and may be appropriately set within the range of about 7.2 to 8.7 mm.

In the first embodiment, the tip of the charge elimination needle 80 is directed toward the upstream end C1 at the first position. As a result, it is possible to form an effective electric field in eliminating charge from the recording material at the separating position.

Further, d1 represents a distance from an upstream end of the charge elimination needle 80 in the recording-material conveying direction to the upstream end C1, and θ1 represents an angle formed by the direction of the tip of the charge elimination needle 80 with the back surface of the separated recording material. Since the separated recording material is conveyed along m1, θ1 represents the angle formed by the direction of the charge elimination needle 80 with m1. In the first embodiment, d1 and θ1 are set at 10.4 mm and 50°, respectively. As a result, the charge elimination effect is prevented from becoming excessive because of small values of θ1 and d1, and from deteriorating because of large values of θ1 and d1. Of course, d1 and θ1 are not limited to these values. The distance d1 may be appropriately set within the range of about 9.4 to 11.4 mm, and the angle θ1 may be appropriately set within the range of about 50° to 55°.

Next, the second position of the charge elimination needle 80 illustrated in FIG. 5B will be described. When the transfer belt 24 is raised by the separation assist rollers 41, recording-material concave portions and recording-material convex portions are formed in the recording material, and the height of the recording material becomes nonuniform in the width direction. The height of the recording material is the largest in the recording-material convex portions and the smallest in the recording-material concave portions. Further, the height is medium at centers (middle portions) between the recording-material concave portions and the recording-material convex portions in the width direction. Accordingly, in the first embodiment, the upstream end of the charge elimination needle 80 is located according to a trajectory m2 of the middle portions of the recording material after separation. This is because the distance between the upstream end of the charge elimination needle 80 and the recording-material convex portions is too large when the upstream end is located according to the recording-material concave portions, and the distance between the upstream end and the recording-material concave portions is too large when the upstream end is located according to the recording-material convex portions.

Since the separated recording material is given stiffness by belt concave portions and belt convex portions formed in the transfer belt 24, the recording-material convex portions are supported by the belt convex portions, and the recording-material concave portions are supported by the belt concave portions. In this state, the height of the trajectory m2 of the middle portions of the recording material is equivalent to that of middle portions between the concave portions and the convex portions of the transfer belt 24. A distance L2 in the perpendicular direction between the tip of the charge elimination needle 80 and the middle portions of the recording material can be regarded as equal to the distance in the perpendicular direction between the tip of the charge elimination needle 80 and the middle portions between the concave portions and the convex portions of the transfer belt 24. Accordingly, the position of the charge elimination needle 80 is set so that the distance in the perpendicular direction between the tip of the charge elimination needle 80 and the middle portions between the concave portions and the convex portions of the transfer belt 24 becomes a predetermined value (7.9 mm). As a result, the distance L2 between the tip of the charge elimination needle 80 and the middle portions of the recording material becomes the predetermined value (7.9 mm). The distance L2 is set to be equal to the distance L1. Of course, the distance L2 is not limited to this value, and may be appropriately set within the range of about 7.2 to 8.7 mm.

In the first embodiment, with reference to the belt surface that is not raised, the height of the convex portions of the transfer belt 24 is 6 mm, and the height of the concave portions of the transfer belt 24 is 0 mm. Therefore, with reference to the belt surface that is not raised, a height h of m2 is (6+0)÷2=3 mm. Of course, the heights are not limited to these values. The height of the convex portions can be set within the range of about 3 to 10 mm. The height h is determined by the height of the convex portions such as to be within the range of about 1 to 5 mm.

In the first embodiment, at the second position, the charge elimination needle 80 is set such as to be directed toward an intersection C3 of m2 and a normal that extends perpendicularly to m2 and passes through C1.

The reason why the charge elimination needle 80 is thus set will be described. When the recording material is separated by using the separation assist rollers 41, a separating position C2 where the middle portions of the recording material separate from the transfer belt 24 is upstream of C1 in the recording-material conveying direction. However, if the tip of the charge elimination needle 80 is directed toward the separating position C2 of the middle portions of the recording material, the separation stretching roller 26 obstructs formation of an electric field. Accordingly, in the first embodiment, the tip of the charge elimination needle 80 is directed at the second position toward a position shifted downstream from the separating position C2. As a result, it is possible to prevent the separation stretching roller 26 from obstructing formation of an electric field to deteriorate the charge elimination effect.

A distance d2 represents a distance from the upstream end of the charge elimination needle 80 in the recording-material conveying direction to the intersection C3. An angle θ2 represents an angle formed by the direction of the charge elimination needle 80 with back surfaces of the middle portions of the recording material after separation. Since the middle portions of the recording material are conveyed along m2 after separation, θ2 refers to an angle formed by the direction of the charge elimination needle 80 with m2. In the first embodiment, d2 and θ2 are set at 10.4 mm and 50°, respectively. That is, a condition that d1=d2 and θ1=θ2 is satisfied. Similarly to d1 and θ1 at the first position, d2 and θ2 are not limited to these values, and may be set appropriately.

While the charge elimination needle 80 translates in the perpendicular direction in the first embodiment, it does not always need to make such motion. It is satisfactory that the tip of the charge elimination needle 80 can move in the perpendicular direction, and the charge elimination needle 80 may be turned.

While the height of the middle portions of the recording material is regarded as equal to the middle portions between the belt concave portions and the belt convex portions in the first embodiment, it is not limited thereto. For example, it may be possible to calculate a height distribution of the transfer belt 24 in the width direction when the transfer belt 24 is raised by the separation assist rollers 41, to find an accurate average height from the height distribution, and to set the found average height as the height of the middle portions of the recording material.

While θ1=θ2 in the first embodiment, the charge elimination needle 80 may be turned so that the tip thereof at the second position is directed toward a position shifted downstream of the separating position C2 of the middle portions of the recording material in the recording-material conveying direction, that is, so that θ1<θ2. In this case, it is possible to suppress reduction of the charge elimination effect resulting from obstruction of formation of the electric field by the separation stretching roller 26.

Control of Charge Elimination Needle 80

An operating position of the charge elimination needle 80 is controlled by the charge-elimination-needle control circuit 52 provided in the control circuit 50. An operating position signal of the charge elimination needle 80 is controlled on the basis of the motion of the separation assist device 40. The operating position of the charge elimination needle 80 is controlled in the following two patterns prestored in the ROM:

(1) When the separation assist device 40 is set at a retracting position and a recording material is separated by utilizing only the curvature of the separation stretching roller 26, the charge elimination needle 80 is located at a low position (first position) in the direction perpendicular to the belt surface that has been subjected to transfer.

(2) When the separation assist device 40 is set at a raising position and forms local projections in the transfer belt 24 in the width direction, the charge elimination needle 80 is located at a position higher than the first position (second position) in the direction perpendicular to the belt surface that has been subjected to transfer.

The reason why these two patterns are set will be described. When the recording material is separated by using the separation assist device 40, the position of the separated recording material is higher than when the recording material is separated by using the separation stretching roller 26. As a result, the distance to the charge elimination needle 80 increases, and the charge elimination effect of the charge elimination needle 80 for the separated recording material deteriorates. That is, in the first embodiment, the cam 81, the spring 82, and the motor 84 illustrated in FIGS. 5A and 5B and the charge-elimination-needle control circuit 52 illustrated in FIG. 4 function as a charge-elimination-needle moving unit that moves the charge elimination needle 80.

A description will now be given of the moving amount of the tip of the charge elimination needle 80 in the perpendicular direction between the first and second positions. In the first embodiment, the moving amount of the tip of the charge elimination needle 80 in the perpendicular direction is set to be equal to the distance from the middle portions between the concave portions and the convex portions of the transfer belt 24 and the belt surface of the transfer belt 24 that is not raised. As a result, the distance L1 in the perpendicular direction from the tip of the charge elimination needle 80 to the belt surface of the unraised transfer belt 24 at the first position is set to be equal to the distance L2 in the perpendicular direction from the tip of the charge elimination needle 80 to the middle portions between the concave portions and the convex portions of the transfer belt 24 at the second position.

When the amount by which the separation assist rollers 41 raise the transfer belt 24 increases, the heights of the concave portions and the convex portions formed in the transfer belt 24 increase. Hence, the moving amount of the charge elimination needle 80 can be increased. In a structure in which the amount by which the separation assist rollers 41 raise the transfer belt 24 is set in multiple steps, the moving amount of the charge elimination needle 80 is set to increase as the raising amount of the transfer belt 24 increases.

Control Flowchart for Separation Assist Device 40 and Charge Elimination Needle 80

Figure 6:
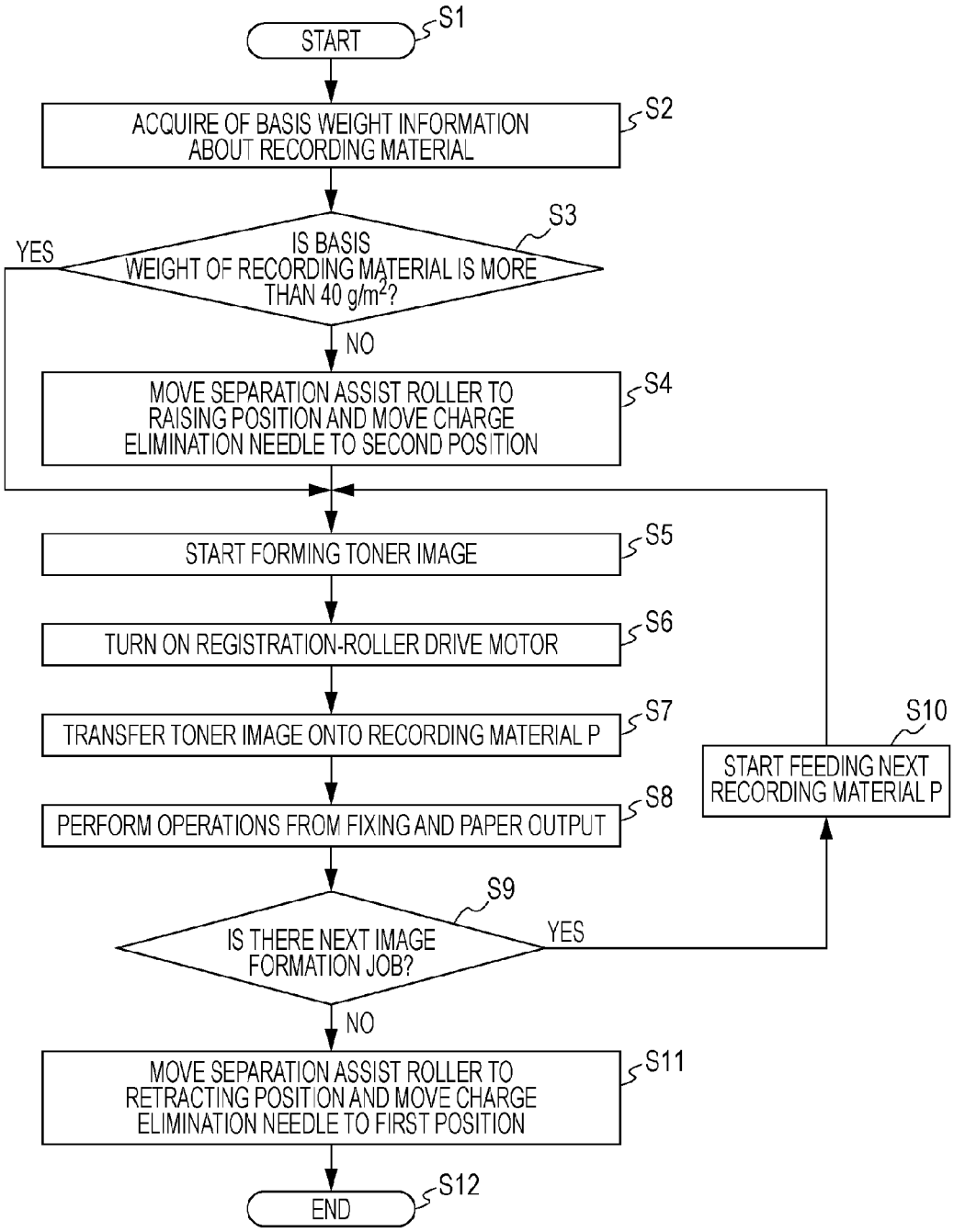
FIG. 6 illustrates a flowchart.

Next, a control flow for the separation assist device 40 and the charge elimination needle 80 will be described with reference to FIG. 6. When an image forming operation starts (Step S1), basis weight information about a recording material P set by the user through the user operation unit 102 is read (Step S2), and it is determined whether or not the basis weight is more than 40 g/m$^2$ (Step S3). When the basis weight of the recording material P is more than 40 g/m$^2$ in Step S3, formation of toner images on the photosensitive drums starts in a state in which the separation assist rollers 41 stay at a retracting position and the charge elimination needle 80 stays at a first position (Step S5). When the basis weight of the recording material P set by the user is 40 g/m$^2$ or less, that is, when the stiffness of the recording material P is low, there is a need to form local projections in the transfer belt 24 by raising the transfer belt 24 with the separation assist rollers 41 in order to separate such a recording material having a low stiffness. The separation assist rollers 41 are moved in the Y1-direction to a raising position to raise the transfer belt 24 (Step S4). At the same time as the separation assist rollers 41 are set at the raising position, the charge elimination needle 80 is set at the second position higher than the first position. After that, formation of toner images on the photosensitive drums starts (Step S5). A registration-roller drive motor is started to drive the registration rollers 8 in synchronization with formation of the toner images (Step S6), thereby supplying the recording material P to the transfer belt 24. The toner images on the photosensitive drums are transferred onto the recording material P at the transfer portion (Step S7). After that, the recording material P is conveyed by the transfer belt 24, is separated from the transfer belt 24 at the separation assistor rollers 41 that are raising the transfer belt 24, and is output from the image forming apparatus through the fixing device 60 (Step S8). In Step S9, it is determined whether or not there is a next image formation job. When there is a next image formation job, a next recording material P is supplied from the sheet supply cassette (Step S10), and the procedure returns to Step S5 while skipping the operation of detecting the stiffness of the recording material P. When it is determined in Step S9 that there is no next image formation job, the separation assist rollers 41 are set at the retracting position. At the same time as the separation assist rollers 41 are set at the retracting position, the charge elimination needle 80 is moved from the second position to the first position (Step S11), and the procedure is finished (S12).

While movement of the separation assist rollers 41 from the retracting position to the raising position and movement of the charge elimination needle 80 from the first position to the second position are performed at the same timing in the first embodiment, the timing is not limited thereto. For example, the separation assist rollers 41 may first be moved from the retracting position to the raising position, and the charge elimination needle 80 may then be moved from the first position to the second position.

While movement of the separation assist rollers 41 from the raising position to the retracting position and movement of the charge elimination needle 80 from the second position to the first position are performed at the same timing in the first embodiment, the timing is not limited thereto. For example, the separation assist rollers 41 may first be moved from the raising position to the retracting position, and the charge elimination needle 80 may then be moved from the second position to the first position. In this case, a period in which the separation assist rollers 41 raise the transfer belt 24 shortens, and this suppresses wear of the transfer belt 24.

In the first embodiment, a portion of the belt surface of the transfer belt 24, which is not raised, from the secondary transfer roller 9 to the separation stretching roller 26 extends horizontally. Since the direction perpendicular to the unraised belt surface of the transfer belt 24 coincides with the vertical direction, the height in the perpendicular direction indicates the position in the vertical direction. Of course, the direction is not limited thereto. For example, the portion of the unraised belt surface of the transfer belt 24 from the secondary transfer roller 9 toward the separation stretching roller 26 may extend in the vertical direction. In this structure, since the direction perpendicular to the unraised belt surface of the transfer belt 24 coincides with the horizontal direction, the height in the perpendicular direction indicates the position in the horizontal direction.

Second Embodiment

Descriptions of the same structures as those adopted in the first embodiment are skipped. While the charge elimination needle 80 is movable in the first embodiment, a separation stretching roller 26 is moved by driving force from a motor 90 in a second embodiment.

Figure 7A:
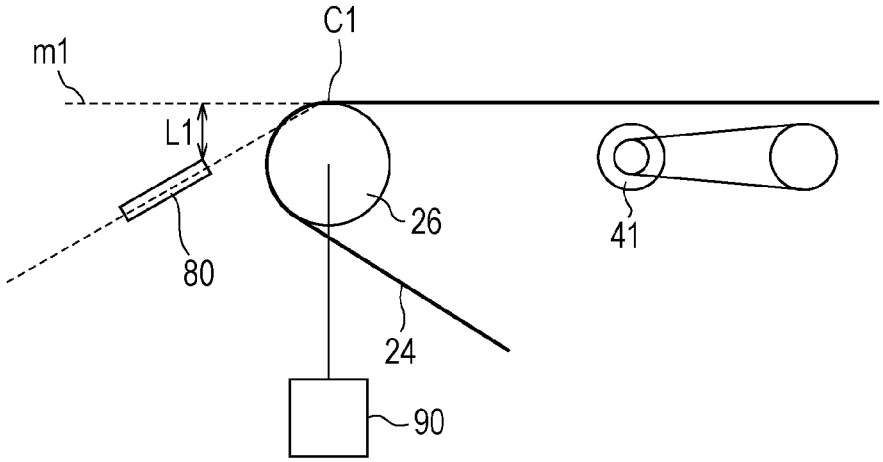
FIGS. 7A and 7B illustrate the motion of a separation stretching roller.

FIG. 7A illustrates a position of the separation stretching roller 26 taken when a recording material is separated without raising a transfer belt 24 by separation assist rollers 41 (first separation-stretching-roller position). At the first separation-stretching-roller position, the positional relationship among the separation stretching roller 26, a charge elimination needle 80, and the transfer belt 24 is the same as that adopted in the first embodiment.

Figure 7B:
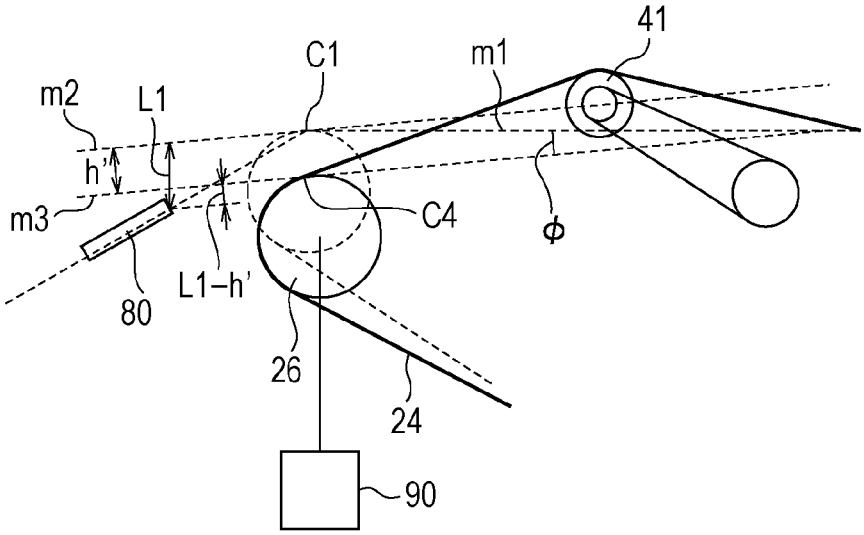

FIG. 7B illustrates a position of the separation stretching roller 26 taken when the separation assist rollers 41 raise the transfer belt 24 to separate a recording material (second separation-stretching-roller position).

In FIG. 7B, m3 represents a belt surface of the transfer belt 24 and an extension plane thereof in a state in which the separation stretching roller 26 is at the second position and the transfer belt 24 is not raised by the separation assist rollers 41, and m2 represents a trajectory of middle portions of the recording material drawn when the separation stretching roller 26 is at the second position and the separation assist rollers 41 raise the transfer belt 24 to separate the recording material. Here, m2 is parallel to m3. A distance h' between m2 and m3 is determined by the raising amount by which the transfer belt 24 is raised by the separation assist rollers 41. As the raising amount of the separation assist rollers 41 increases, h' increases. An angle $\phi$ is formed by the belt surface of the transfer belt 24 at the first separation-stretching-roller position and the belt surface of the transfer belt 24 at the second separation-stretching-roller position.

In the second embodiment, the second separation-stretching-roller position is set to be lower than the first separation-stretching-roller position in the direction perpendicular to m1. That is, the trajectory of the recording material after separation is lowered, and this suppresses the increase in distance between the charge elimination needle 80 and the recording material. As a result, even when the recording material is raised by using the raising unit, it is possible to suppress deterioration of the charge elimination effect of the charge elimination needle 80 for the separated recording material.

In the second embodiment, the angle ϕ and the position of the separation stretching roller 26 in the direction perpendicular to m1 are set so that the distance between the extension plane m3 of the belt surface of the transfer belt 24 and the charge elimination needle 80 at the second separation-stretching-roller position is equal to L1−h'. As a result, the distance between the middle portions of the recording material and the charge elimination needle 80 becomes L1 when the recording material is separated by using the separation assist rollers 41. That is, the distance between the middle portions of the recording material and the charge elimination needle 80 can be optimized when the separation assist rollers 41 are used without moving the charge elimination needle 80.

Figure 8:
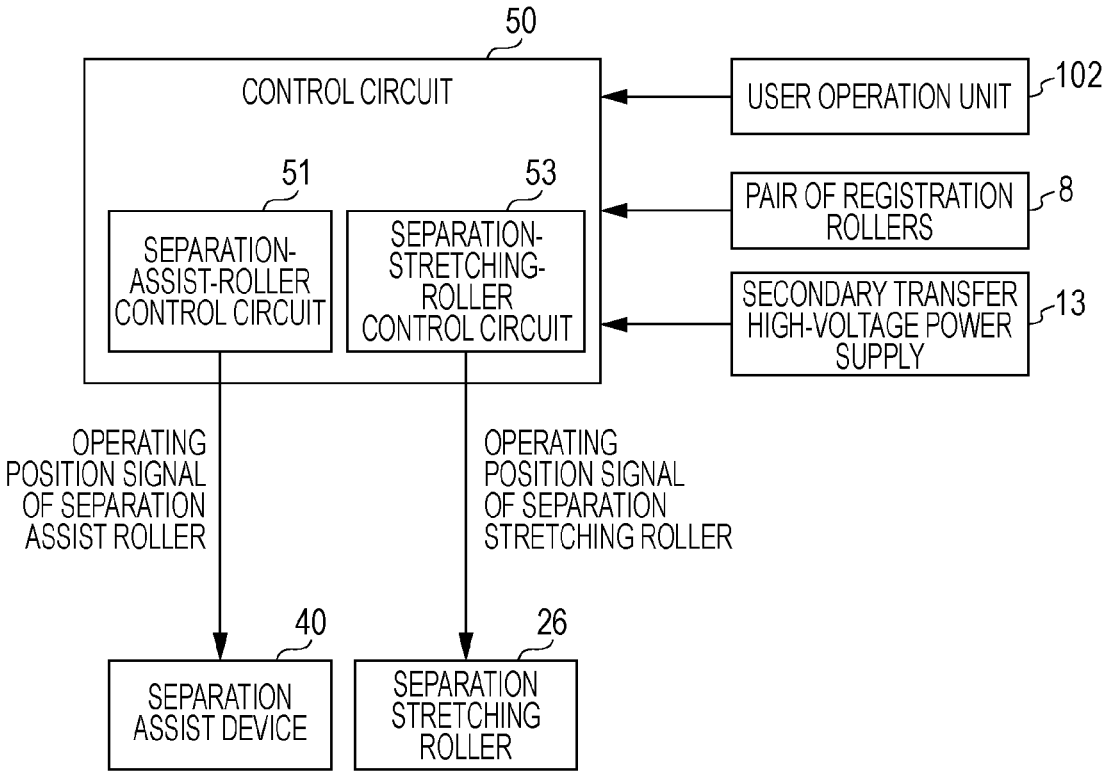
FIG. 8 is a block diagram of a control circuit according to a second embodiment.

A control circuit 50 in the second embodiment will be described with reference to FIG. 8. In the second embodiment, the control circuit 50 includes a separation-stretching-roller control circuit 53 that controls the operation of the separation stretching roller 26, instead of the charge-elimination-needle control circuit 52 that controls the charge elimination needle 80. The operating position of the separation stretching roller 26 is controlled in the following two patterns prestored in a ROM.

(1) When the separation assist device 40 is at a retracting position and a recording material is separated by utilizing the curvature of the separation stretching roller 26, the separation stretching roller 26 is set at a high position in the direction perpendicular to the belt surface subjected to transfer (first separation-stretching-roller position).

(2) When the separation assist device 40 is at a raising position and forms local projections in the transfer belt 24 in the width direction, the separation stretching roller 26 is set at a position lower than the first separation-stretching-roller position in the direction perpendicular to the belt surface subjected to transfer (second separation-stretching-roller position).

That is, the separation-stretching-roller control circuit 53, the motor 90, etc. function as a separation-stretching-roller moving unit that moves the separation stretching roller 26. Further, as described above, the distance between the middle portions of the recording material and the charge elimination needle 80 provided when the recording material is separated by using the separation assist rollers 41 becomes L1. As a result, the distance between the middle portions of the recording material and the charge elimination needle 80 can be optimized when the separation assist rollers 41 are used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-277322 filed Dec. 13, 2010, which is hereby incorporated by reference herein in its entirety.

What is claimed is:

1. An image forming apparatus comprising:

an image bearing member configured to bear a toner image;

a movable belt member configured to bear and convey a recording material;

a transfer member configured to electrostatically transfer the toner image formed on the image bearing member onto the recording material born and conveyed by the belt member;

a raising unit configured to raise the belt member from an inner surface side at a position downstream of the transfer member in a conveying direction of the recording material so a surface of the belt member locally projects in a width direction of the belt member;

a separation stretching member configured to stretch the belt member at a position downstream of the raising unit in the conveying direction of the recording material to separate the recording material from the belt member;

a charge elimination needle arranged downstream of the separation stretching member in the conveying direction of the recording material to eliminate a charge from the recording material;

an execution unit configured to execute a first mode in which a recording material having a first thickness is conveyed by the belt member and is separated by the separation stretching member without raising the belt member by the raising unit and a second mode in which a recording material having a second thickness less than the first thickness is conveyed by the belt member and the belt member is raised by the raising unit; and a charge-elimination-needle moving unit configured to move the charge elimination needle so the charge elimination needle is located at a first position in the first mode and the charge elimination needle is located in the second mode at a second position higher than the first position in a perpendicular direction perpendicular to the surface of the belt member that is not raised by the raising unit between the transfer member and the separation stretching member.

2. The image forming apparatus according to claim 1, wherein the charge elimination needle is located so a distance in the perpendicular direction from a tip of the charge elimination needle to a middle height between heights of a concave portion and a convex portion formed in the belt member in the second mode is equal to a distance in the perpendicular direction from the tip of the charge elimination needle to the surface of the belt member that is not raised by the raising unit between the transfer member and the separation stretching member in the first mode.

3. The image forming apparatus according to claim 1, wherein an angle formed by a direction of a tip of the charge elimination needle and the surface of the belt member that is not raised by the raising unit between the transfer member and the separation stretching member in the second mode is equal to an angle formed by the direction of the charge elimination needle and the surface of the belt member that is not raised by the raising unit between the transfer member and the separation stretching member in the first mode.

4. An image forming apparatus comprising:

an image bearing member configured to bear a toner image;

a movable belt member configured to bear and convey a recording material;

a transfer member configured to electrostatically transfer the toner image formed on the image bearing member onto the recording material born and conveyed by the belt member;

a raising unit configured to raise the belt member from an inner surface side at a position downstream of the transfer member in a conveying direction of the recording material so a surface of the belt member locally projects in a width direction of the belt member;

a separation stretching member configured to stretch the belt member at a position downstream of the raising unit in the conveying direction of the recording material to separate the recording material from the belt member;

a charge elimination needle arranged downstream of the separation stretching member in the conveying direction of the recording material to eliminate a charge from the recording material;

an execution unit configured to execute a first mode in which a recording material having a first thickness is conveyed by the belt member and is separated by the separation stretching member without raising the belt member by the raising unit and a second mode in which a recording material having a second thickness less than the first thickness is conveyed by the belt member and the belt member is raised by the raising unit; and a charge-elimination-needle moving unit configured to move the charge elimination needle so the charge elimination needle is directed toward a more downstream side in the conveying direction of the recording material in the second mode than in the first mode.

* * * * *